US005882095A

United States Patent [19]

Green

[11] Patent Number: 5,882,095

[45] Date of Patent: Mar. 16, 1999

[54] PORTABLE PRAYER ALTAR

[76] Inventor: Donald E. Green, 1008 St. Paul Ct., Apt. 4, Louisville, Ky. 40203

[21] Appl. No.: 48,415

[22] Filed: Mar. 26, 1998

[51] Int. Cl.[6] ..... A47G 33/00

[52] U.S. Cl. ..... 312/533; 312/235.3

[58] Field of Search ..... 312/33, 235.2, 312/235.3, 235.1; 206/19; D99/25

[56] References Cited

U.S. PATENT DOCUMENTS

| | | | |
|---|---|---|---|
| D. 151,214 | 10/1948 | Buckner | D33/19 |
| D. 245,381 | 8/1977 | Lilley | D6/155 |
| D. 306,535 | 3/1990 | Evenson | D6/419 |
| D. 339,933 | 10/1993 | Fafoutis | D6/419 |
| D. 357,825 | 5/1995 | Gillam | D6/419 |
| 2,348,472 | 5/1944 | Hart | 312/33 |
| 3,011,848 | 12/1961 | Hasson | 312/33 |
| 3,120,410 | 2/1964 | Berg | 312/33 |
| 4,784,382 | 11/1988 | Myers | 272/25 |
| 5,031,975 | 7/1991 | Anderson | 312/319.7 |

*Primary Examiner*—Peter M. Cuomo
*Assistant Examiner*—Gerald A. Anderson
*Attorney, Agent, or Firm*—Henderson & Sturm

[57] ABSTRACT

A portable prayer altar including an enclosure having an open rear wall facing the user. A padded kneeling mechanism is pivotally attached to the interior bottom wall and is movable between a lowered position for use, and a raised position for storage. A rotary air driven motor, in communication with an air compressor and air storage tank, is operably attached to the kneeling mechanism. An activation switch coupled to the motor is carried on the side wall of the enclosure and is readily accessible to the user.

5 Claims, 1 Drawing Sheet

PORTABLE PRAYER ALTAR

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of prayer and meditation accessories, and more particulary to a portable altar for use in a home or apartment.

2. Description of Related Art

As can be seen by reference to the following U.S. Pat. No. 4,784,382; Des. U.S. Pat No. 151,214; Des. U.S. Pat. No. 245,381; Des. U.S. Pat. No. 306,535; Des. U.S. Pat. No. 339,933; and Des. U. S. Pat. No. 357,825, the prior art is replete with myriad and diverse prayer altars.

While all of the aforementioned prior art constructions are more than adequate for the basic purpose and function for which they have been specifically designed, they are uniformly deficient with respect to their failure to provide a simple, efficient, and practical portable prayer altar.

As a consequence of the foregoing situation, there has existed a longstanding need for a new and improved prayer altar and the provision of such a construction is a stated objective of the present invention.

BRIEF SUMMARY OF THE INVENTION

Briefly stated, the present invention provides a portable prayer altar including an enclosure having an open rear wall facing the user. A padded kneeling mechanism is pivotally attached to the interior bottom wall and is movable between a lowered position for use, and a raised position for storage. A rotary air driven motor, in communication with an air compressor and air storage tank, is operably attached to the kneeling mechanism. An activation switch coupled to the motor is carried on the side wall of the enclosure and is readily accessible to the user.

BRIEF DESCRIPTION OF THE SEVERAL VIEWS OF THE DRAWINGS

These and other attributes of the invention will become more clear upon a thorough study the following description of the best mode for carrying out the invention, particularly when reviewed in conjunction with the drawings, wherein.

DETAILED DESCRIPTION OF THE INVENTION

Figure 1:
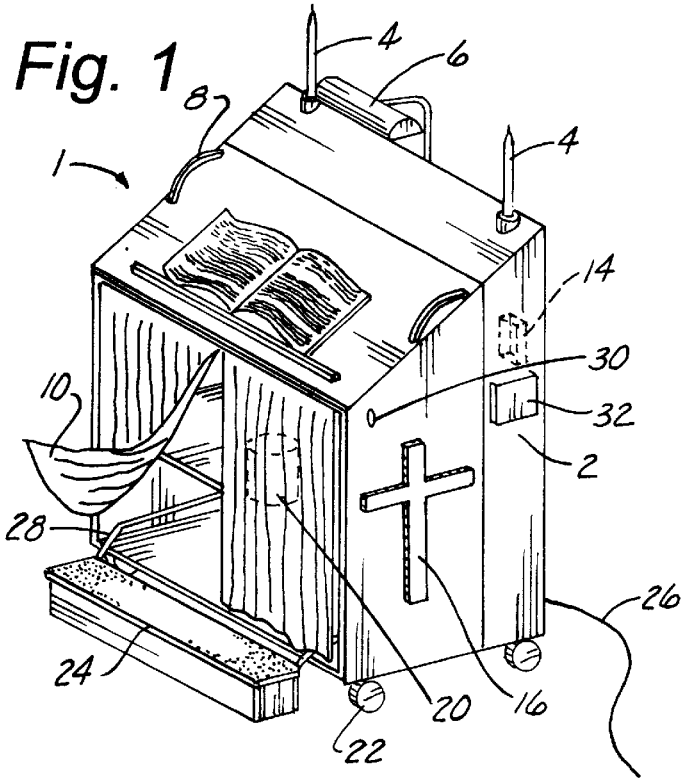
FIG. 1 is perspective view of the portable prayer altar of the present invention.

As can be seen by reference to the drawings, and in particularly to FIG. 1, the portable prayer altar that forms the basis of the present invention is designated generally by the reference number 1. The portable altar 1 includes an enclosure 2 having a bottom wall, a front wall, a pair of opposing side walls, an inclined top surface for supporting notes and books, and an open rear wall facing the user. The enclosure 2, best shown in FIGS. 1 and 2, have fixtures or attachments which allow attachment of the following parts: the optional candles 4, the optional lamp 6, the positioning handles 8, gold optional, the curtain option 10, the glass door option 12, the electrical outlet 14, the decorative cross 16, the optional backboard 18 with prayer hands design and stabilizing posts, the air compressor 20, the caster 22, the padded movable kneeling mechanism 24, the electrical cord 26, the kneeling mechanism pivot braces 28, and the activation button 30.

Figure 3:
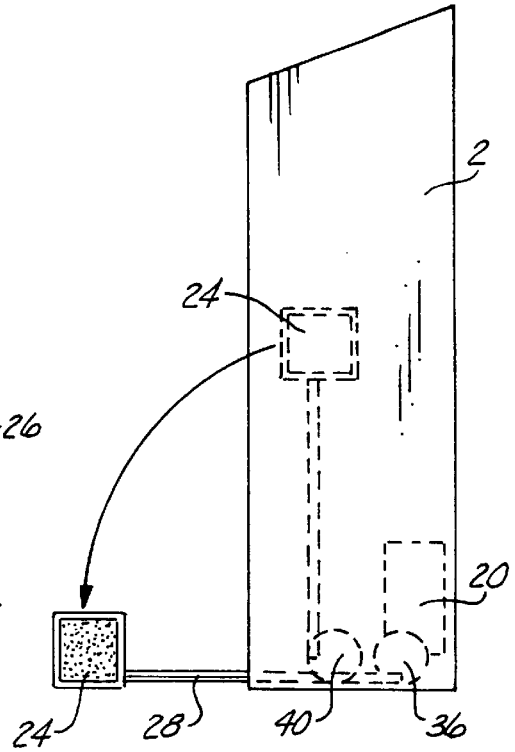
FIG. 3 is a side elevational schematic view illustrating the operation of the movable kneeling mechanism.
Figure 4:
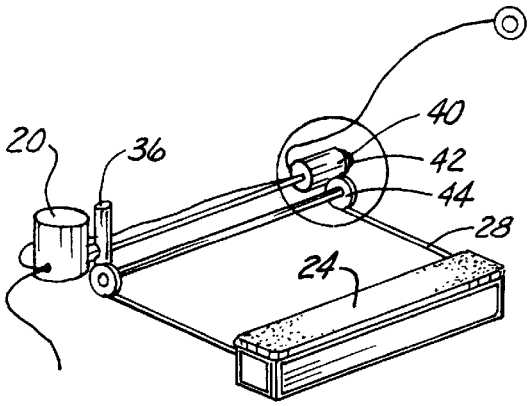
FIG. 4 is a perspective view showing the components of the movable kneeling mechanism.

FIGS. 3 and 4 further illustrate in detail the technical relationship of the enclosure 2, and the folding kneeler 24, the air compressor 20, the compressed air storage tank 36, the rotary air driven motor 40, the driving gear 42, the driven gear 44, and the kneeler activation button 30.

The design of the portable prayer altar 1 is that of a collapsible, portable altar which has been designed for use with any religion for religious prayer at any time, anywhere.

Figure 2:
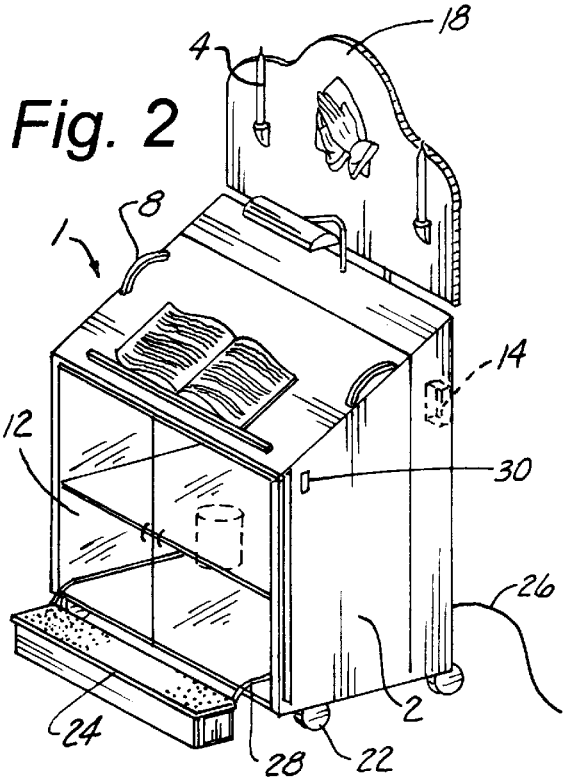
FIG. 2 is a perspective view of the prayer altar showing optional features available.

The main enclosure 2 of the portable prayer altar 1 is manufactured of a lightweight polyurethane plastic that provides a wood appearance. The portable prayer altar 1 incorporates many optional features including the capability to collapse for storage and travel. The portable prayer altar is able to collapse by use of interior mounted hinges. The interior of the portable prayer altar 1 also could house shelving for storage of Bibles, candles 4, or any other items which one may use while mediating or praying. The shelving section could be encased in a smoke stained sliding glass window 12, or as an added option, curtains 10 may be utilized in place of the sliding glass 12. The portable prayer altar 1 features a battery operated light 6 at the top section for use when reading, and many added features, such as a cross 16, top handles 8 for positioning could be gold plated, and candles 4. The light 6 could be plugged into an interior mounted female electrical outlet 14 which would lead to an exterior cord and plug 26. Other items, i.e., tape recorder, could also be plugged into the female outlet 14 with ease then placed into an optional bracket 32 mounted on the outside of the unit. The portable prayer altar 1 also could feature an interior battery operated light located on the inside of the shelving area. The portable prayer altar 1 could allow the user the capability of selecting an appropriate backboard 18 to coordinate with his or her beliefs, for example, an altar for anyone could feature praying hands as illustrated in FIG. 2. Jewish religions would have the option of selecting a backboard 18 with the Star of David, Catholic religions could select a backboard 18 of Mary, or Jesus on the cross, etc.

The portable prayer altar 1 embodies a padded kneeling mechanism 24 which may be retracted and extended by the press of a button 30 located on the side of the portable prayer altar 1. The kneeler 24 would come down by the use of compressed air driving a rotary pneumatic motor 40. The air motor 40 has a small driving gear 42 attached to its shaft. The small gear 42 mates face-to-face with a larger driven gear 44 attached to the kneeler 24. The bottom of the portable prayer altar 1 carries four casters 22, or wheels, which allow the portable prayer altar 1 to be moved when needed.

In use, anyone wishing to further their faith by having their own personal altar in their home or apartment would first select the appropriate backboard 18 according their beliefs. The portable prayer altar 1 would be set up by holding on to the positioning handles 8 on the top of the portable prayer altar 1, and assembling as specified. The shelves could be added and the glass sliding windows 12 could be placed into their appropriate positions, or the curtains 10 placed appropriately. The user could place any items on the shelving as desired and could turn on the battery operated light 6 and plug in a tape cassette recorder or other items which require electricity. The exterior plug 26 would be connected to a standard wall outlet. The user could have the option of candles 4, and a light 6, if needed, which would also be plugged into the interior female outlet 14.

The side mounted button 30 would be compressed to release the kneeler 24 via the interior stored compressor unit 20. The believer would pray or mediate as they would inside of a church, synagogue, or temple. Use of the portable prayer altar 1 would provide people of all faiths with the capability to pray or mediate at any time they desire. When not in use, the portable prayer altar 1 could be stored in a closed, or other appropriate storage area.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A portable prayer altar comprising:

an enclosure having a bottom, a front wall, a pair of opposing side walls, a top inclined surface for supporting notes and books, and an open rear wall disposed to face a person using the altar;

a padded kneeling mechanism pivotally attached to the bottom of the enclosure, the kneeling mechanism being movable between a lowered position wherein the kneeling mechanism is disposed exterior of the enclosure, and a raised storage position wherein the kneeling mechanism is disposed completely interior of the enclosure;

a rotary air driven motor disposed within the enclosure and operably attached to the kneeling mechanism for moving the kneeling mechanism between the lowered and raised positions;

an air compressor coupled to an air storage tank disposed within the enclosure in fluid communication with the air driven motor; and an activation switch operably attached to the rotary air driven motor and disposed on a side wall of the enclosure.

2. The portable altar of claim 1 wherein the enclosure is carried on floor engaging caster wheels.

3. The portable altar of claim 2 further including curtains disposed to cover the open rear wall of the enclosure.

4. The portable altar of claim 2 further including glass doors disposed to cover the open rear wall of the enclosure.

5. The portable altar of claim 2 wherein the enclosure is formed of polyurethane replicating the appearance of wood.

* * * * *